US006532885B1

(12) United States Patent
Cordoba

(10) Patent No.: US 6,532,885 B1
(45) Date of Patent: Mar. 18, 2003

(54) MOORING DEVICE

(76) Inventor: Marcos Roberto Cordoba, Virrey Del Pino 1750, 5° "B", Buenos Aires (AR)

( * ) Notice: Subject to any disclaimer, the term of this patent is extended or adjusted under 35 U.S.C. 154(b) by 0 days.

(21) Appl. No.: 10/077,656

(22) Filed: Feb. 15, 2002

(51) Int. Cl.[7] ..... B63B 21/00
(52) U.S. Cl. ..... 114/230.26; 114/230.27; 114/230.2
(58) Field of Search ..... 114/230.1, 230.2, 114/230.26, 230.27, 230.28, 230.29, 230.3, 293; D12/317, 167, 168; 405/211, 212, 213, 214, 215

(56) References Cited

U.S. PATENT DOCUMENTS 1,266,050 A * 5/1918 Reynolds ..... 405/211
3,401,413 A * 9/1968 Anselmi ..... 441/25
3,430,598 A * 3/1969 Soderberg ..... 114/230.27
3,486,342 A * 12/1969 Aks ..... 405/212
3,830,187 A * 8/1974 McGahee ..... 114/230.27
4,357,891 A * 11/1982 Sluys ..... 114/230.27
4,488,502 A * 12/1984 Girard ..... 114/230.26
4,726,313 A * 2/1988 Neal ..... 114/230.27
5,467,727 A * 11/1995 Godvin et al. ..... 114/230.27
5,694,879 A * 12/1997 Taylor ..... 114/230.26
5,937,781 A * 8/1999 Isella et al. ..... 114/230.26
6,062,158 A * 5/2000 Blanchard ..... 114/230.27
6,357,378 B1 * 3/2002 Hile ..... 114/230.2

* cited by examiner

*Primary Examiner*—D. Glenn Dayoan
*Assistant Examiner*—Ajay Vasudeva
(74) *Attorney, Agent, or Firm*—Norris McLaughlin & Marcus

(57) ABSTRACT

A mooring device for mounting freely around a mooring post for making fast a boat, the device comprising a collar for mounting around the post in a manner that the collar can move up and down according to the tide along the post, with one stem connected to the collar and freely movable around the collar and a buoy in the stem for keeping the collar and stem floating in the water, the stem including a distal ring for connecting a rope for making fast the boat.

12 Claims, 2 Drawing Sheets

MOORING DEVICE

BACKGROUND OF THE INVENTION

1. Field of the Invention

The present invention relates to the field of sailing and boating and more particularly to means for making fast a sailboat, a motor boat or any other kind of boat and ship by a simple and easy mooring operation in a mooring post.

For the purpose of the present specification the term "mooring post" indicates any means, such as a wood or concrete post, a column, etc., that is firmly affixed in the land or in a water body and that is capable of receiving the mooring device of the invention for making fast any kind of boat in the water, such as in a dock, pier, wharf and the like.

2. Description of the Prior Art

It is well known in the art of sailing, either in sail boats and/or motor boats, to provide several types of means for making fast the boat when arriving in the docks. One of those means for securing a boat in place is the well know mooring post generally consisting of a wood post that is affixed at the bottom of the river, lake, or any water body by thrusting or pricking, for example. A mooring post may also be affixed to the land, close to the water.

For mooring purposes a pier, wharf and/or dock is provided with a plurality of mooring posts forming a line along the coast and uniformly spaced apart from each other thus forming mooring spaces at each side of a mooring post. Therefore, a post is generally used for more than one boat, more particularly one boat at each side of the post, which boats are made fast by means of chains, ropes, or any other types of lines affixed to the post. The line, generally a rope, has a proximal end forming a lace around the post, the lace being closed by a knot and being loose enough to permit the lace to move up and down along the post.

The lines used for securing the boat in place to the post are generally provided with buoys for keeping the line accessible in the surface of water. When a moored boat is left loose to have the boat free for sailing purposes, the mooring line is untied from the boat and is dropped into the water or hanged in any part of the post, in a hook, for example.

Since each boat at the side of the post needs a line laced to the post as above described, it is quite common that the two lines, one for each boat, result entangled enough to make both laces gripping the post in a way that the same are prevented from freely moving along the post. Under these circumstances, it may be common for a crow of a boat arriving in a dock to spent a lot of time for recovering the line if the same was not hanging from the post and the distal end of the line is sunk into the water.

To make the thinks worse, if the tide is hide and the laces are gripped around the post at a place well down into the water, it may be difficult to have access to the line. In any case, if the laces are entangled and gripped around the post, the line length results shorter than it is convenient for the boat safety.

It would be therefore convenient to have a new mooring system for guaranteeing not only the easy access to the mooring line at the time of the mooring maneuvers but also to have the mooring line always freely moving along the post and floating at the water surface in all the several tides.

SUMMARY OF THE INVENTION

It is therefore one object of the present invention to provide a simple, efficient and cost effective device that may be mounted along a mooring post for retaining a mooring line, with the inventive device being capable of freely floating and moving along the post to be always accessible at the surface of the water for facilitating the mooring maneuvers.

It is still another object of the present invention to provide a mooring device for mounting freely around a mooring post for making fast a boat, the device comprising a collar for mounting around the post in a manner that the collar can move up and down according to the tide along the post, with one stem connected to the collar and freely movable around the collar and a buoy in the stem for keeping the collar and stem floating in the water, the stem including a distal ring for connecting a line for making fast the boat.

It is a further object of the present invention to provide a mooring device for use in a mooring post for making fast a boat, the device comprising a collar for mounting around the post, at least one stem having a proximal end connected to the collar and freely movable around at least part of the collar and a distal end having means for connecting a line for mooring the boat, and a buoy means in said stem for keeping the collar and stem floating in the water with the distal end of the stem available at a surface of the water.

The above and other objects, features and advantages of this invention will be better understood when taken in connection with the accompanying drawings and description.

BRIEF DESCRIPTION OF THE DRAWINGS

The present invention is illustrated by way of example in the following drawings wherein.

DESCRIPTION OF THE PREFERRED EMBODIMENTS

Figure 1:
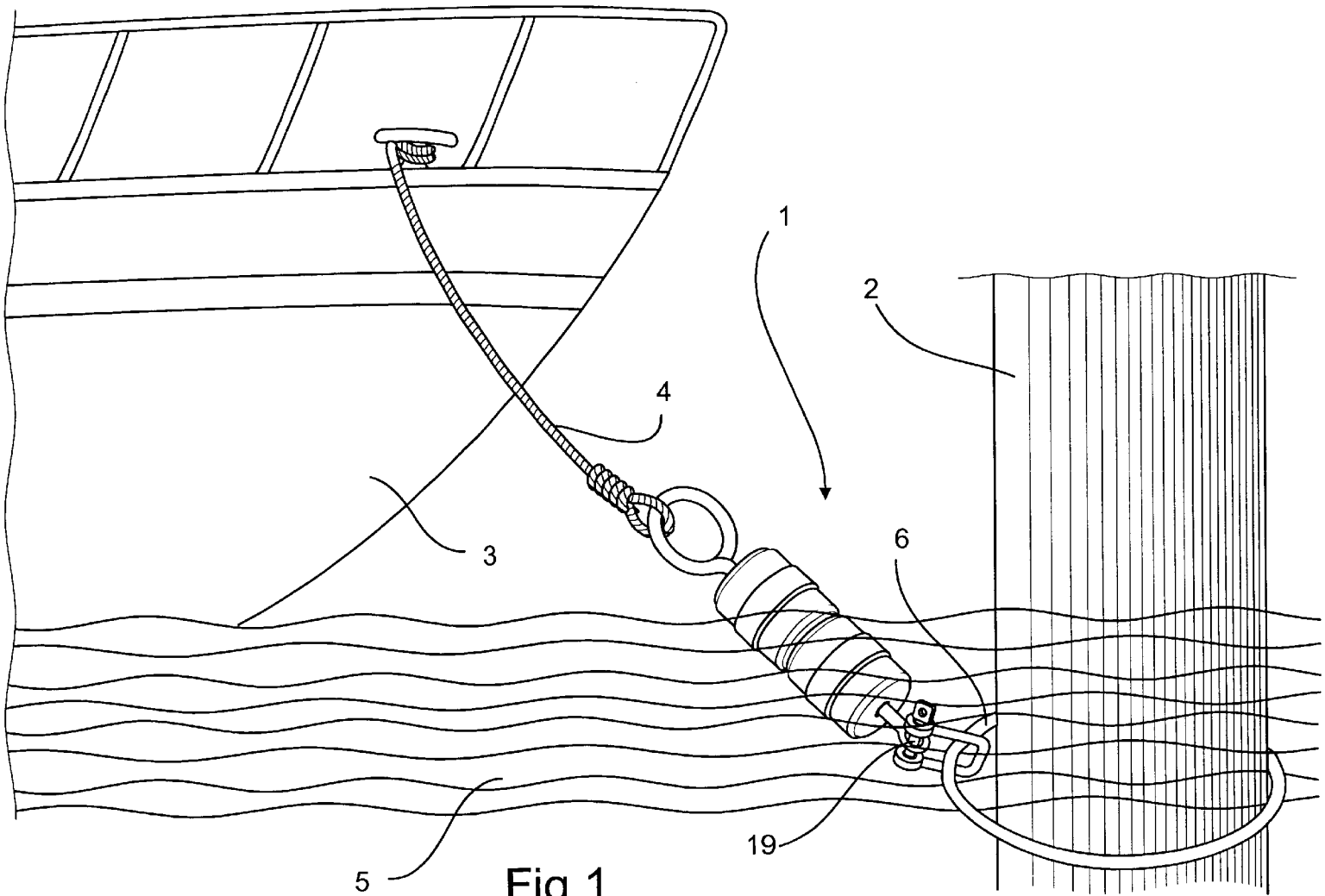
FIG. 1 shows a front elevational view of a boat moored to a mooring post using the mooring device according to one embodiment of thee invention.
Figure 2:
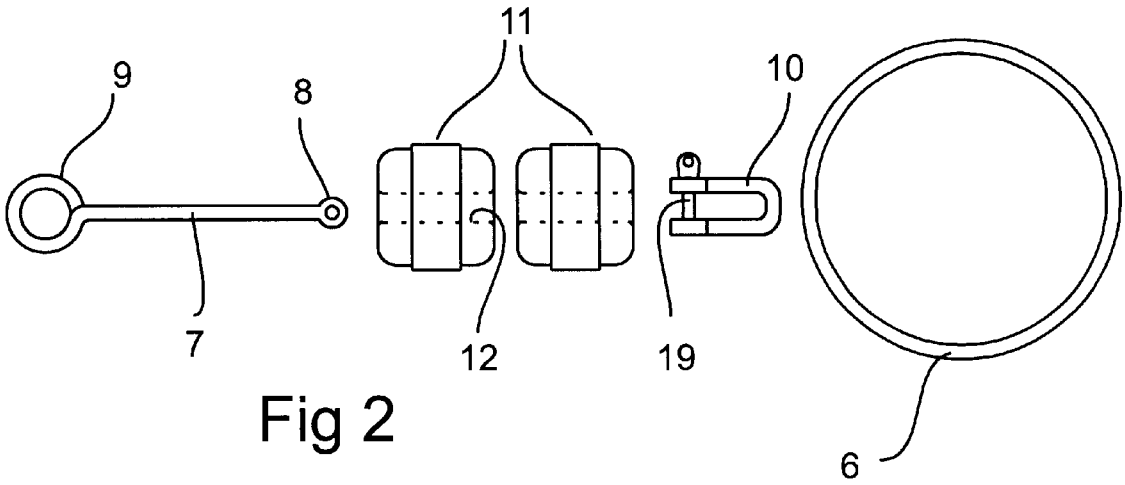
FIG. 2 shows an exploding plant view of the mooring device of FIG. 1.

Now referring in detail to the drawings it may be seen from FIGS. 1 and 2 a mooring device according to the invention, indicated by general reference 1 and mounted over a mooring post 2 well known in the art. A boat 3 is also illustrated as being docked in a mooring space at one side of post 2, with the boat being made fast by means of a line 4, such as a cable, chain or rope, and preferably a rope, that has an end connected to mooring device 1 and an opposite end removably connected to the boat, in a cleat, for example. As may be clearly seen from FIG. 1, the device of the invention remains floating at the surface 5 of the water, thus being always accessible to the boat crew for any mooring operation when arriving in the dock.

As it is more clearly illustrated in FIG. 2, in an exploding perspective view, mooring device 1 comprises a collar 6 for mounting over and around the post, as shown in FIG. 1. One or more stems 7 may be provided in the collar, with each stem having a proximal end provided with a small proximal ring 8, for connecting to the collar and freely movable around at least part of the collar and a distal end having means, preferably a larger distal ring 9, for connecting a rope, such as line 4, for mooring the boat.

Small proximal ring 8 is connected to a shackle 10 which in turn is connected to the collar in a way that the shackle can freely move all around, or partially around, the collar to permit the stem and mooring line freely move around the post and thus accommodate to the boat mooring maneuvers. Shackle 10 is preferably made of galvanized steel and may be of any type provided with several well known lock means such as a pin or bolt 19.

Buoy means, preferably one or more buoys 11, are placed over stem 8 for keeping the collar and stem floating in the water with the distal end of the stem available at surface 5 of the water. Buoy 11 has a central longitudinal opening 12 with an inner diameter dimension enough for receiving stem 7. Small proximal ring 8 also has a dimension for passing through said central opening of the buoy and larger distal ring 9 has a dimension larger than said central opening, whereby the buoy is retained in the stem between shackle 10 and the larger distal ring of the stem, as it is shown in FIG. 1.

With the mooring device disassembled as shown in FIG. 2, buoys are placed over stem 7 by passing ring 8 and stem 7 through longitudinal opening 12 of the buoys. Then, shackle 10 is opened and passed around collar 6, and subsequently pin 18 is passed through ring 8 and the shackle is closed, whereby stem 7 is retained in the collar with capacity for freely moving around the collar and the buoys are retained in the stem between shackle 10 and distal ring 9.

Figure 3:
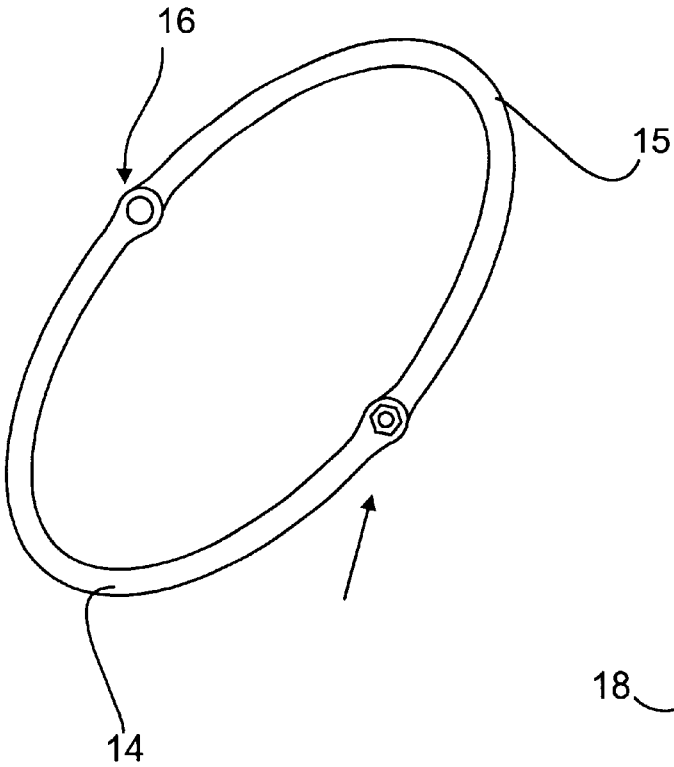
FIG. 3 shows a partial cross-sectional view of a mooring device according to another embodiment of the invention.
Figure 4:
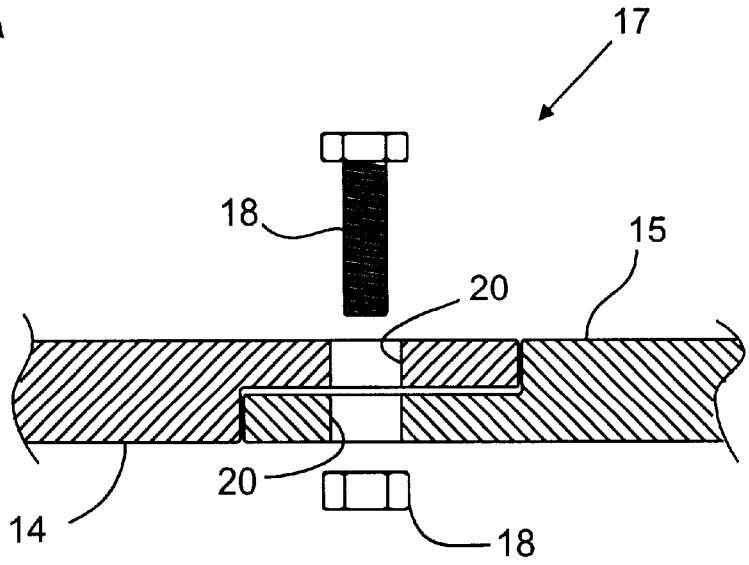
FIG. 4 shows a partial cross-sectional view of a hinge means used in the collar of FIG. 3.

According to another embodiment of the invention, illustrated in FIGS. 3 and 4, collar 13 comprises at least two collar portions, preferably two semi-collars 14, 15, having respective ends connected to each other by hinge means 16, 17. The hinged connections 16, 17 of semi-collars 14, 15 have the capacity of being opened and closed, whereby the collar portions are operable between an open position to permit the collar be placed around the post, and a closed position to retain the collar around the post. While the ends of the semi-collars are illustrated as having a section reduced as compared with the entire semi-collar, these ends will have the dimension necessary to comply with the resistance requirements of the assembly. Like in the embodiment of FIGS. 1, 2, the collar portions are preferably made of anti-corrosion material or any other proper material. Each hinge means 16, 17 comprises a ring or orifice 20 formed at the corresponding end of the semi-collar portion of the collar, preferably by stamping, punching or drilling operation, wherein a bolt-nut assembly 18 (only one shown in FIGS. 3, 4) is passed through the orifices of the ends connected together in order to keep the collar closed around the post. While only one bolt-nut assembly has been shown in one hinge means 16, 17, it is clear that the invention provides a bolt-nut assembly in each hinge means or, alternatively, one of the hinge means may be provided with a non removable rivet or pin for defining a pivoting connection and the other hinge means is provided with the above mentioned removable bolt-nut assembly. Also alternatively, the bolt-nut assembly may be replaced by a pin passing through orifices 20 with the pin retained into the orifices by a washer and key set (not illustrated). Therefore, for mounting the collar around a post, only one bolt-nut assembly is removed from one of hinge means 17, to open the collar around the pivotal connection of the other hinge means 16. Once the collar is placed around the post, bolt 18 is inserted again into hinge means 17 and the collar is closed.

The other components of the mooring device, namely stem 7, with its proximal ring 8 and distal ring 9, and buoy or buoys 11, are the same like in the embodiment of FIGS. 1, 2. Shackle 10, however, is not necessary for use with collar 13 because ring 8 has an inner diameter enough for passing over the open ends of semi-collars and placed to slide along the corresponding semicollar. As an additional advantage of the present invention, the stem connected to each semi-collar will have a capacity of freely moving along the semi-collar between the hinge means 16, 17, however, once bolt-nut assemblies 18 are assembled into orifices 20 of hinge means 16, 17, the hinge means will have a dimension exceeding the inner diameter of rings 8, whereby the stem moving along a semi-collar is prevented from passing over the hinge means and, therefore, into the other semi-collar. In this way, any probable entangling between the lines 4 at each side of the post is prevented and each stem as well as its associated line will be kept spaced apart at each side of the post.

The inventive collars, as well as the stems and shackles, may be made of any suitable material capable of resisting the corrosive and abrasive outdoor conditions, more particularly taking into consideration the aggressive conditions of salt water in the sea. These components of the inventive device may be made of stainless steel, galvanized iron or steel, a variety of polymers, resins, etc., all having the necessary resistance to the stresses the device will be subject to.

In all the above disclosed embodiments of the invention, stem 7 and small proximal and larger distal rings 8, 9, thereof are preferably only one integral piece made of galvanized steel or iron. In addition, while only one stem 7 has been illustrated in FIG. 1, two, or even more, stems t may be connected to collar 6 or 13.

The buoys may be made, as illustrated, from hollow bodies made of plastics, however, other constructions are also applicable to the invention, which buoy constructions may be easily available in the market, such as a hollow body made of polypropylene, a foam plastic body or cork. The buoy(s) may have a longitudinal opening extending along and through the buoy body for passing the proximal end of the stem or may be molded directly onto the stem. If the longitudinal opening is provided, the buoy(s) may be easily replaced in the event of any of them are broken by an accidental collision of the boat against the post.

While preferred embodiments of the present invention have been illustrated and described, it will be obvious to those skilled in the art that various changes and modifications may be made therein without departing from the scope of the invention as defined in the appended claims.

I claim:

1. A mooring device for use in a mooring post for making fast at least one boat, the device comprising:

a collar for mounting around the post, at least one stem having a proximal end having a small proximal ring connected to a shackle which in turn is connected to the collar and freely movable around at least part of the collar, and a distal end having a larger distal ring for connecting a line for mooring the at least one boat, and a buoy means in said stem for keeping the collar and stem floating in the water with the distal end of the stem available at a surface of the water, the buoy means comprising at least one buoy having a central opening for receiving said stem, with the small proximal ring having a dimension for passing through said central opening of the buoy and the larger distal ring of the stem having a dimension larger than said central opening, whereby the buoy is retained in the stem between the shackle and the larger distal ring of the stem.

2. The mooring device of claim 1, wherein the collar comprises one integral piece made of a anti-corrosion material.

3. The mooring device of claim 1, wherein the collar comprises at least two collar portions removably hinged to each other whereby the collar portions are operable between an open position to permit the collar be placed around the post, and a closed position to retain the collar around the post, the collar portions being made of an anti-corrosion material.

4. The mooring device of claim 1, wherein the small proximal ring passes over one of the collar portions and moves along said collar portion.

5. The mooring device of claim 1, wherein the buoy means comprises at least one buoy made of a hollow plastic body.

6. The mooring device of claim 1, wherein the buoy is made of polypropylene.

7. The mooring device of claim 1, wherein the buoy means comprises at least one buoy made of a foam plastic body.

8. The mooring device of claim 1, wherein the buoy means comprises at least one buoy made of cork.

9. The mooring device of claim 1, wherein the collar comprises two semi-collars having respective ends connected to each other by hinge means, with one stem connected to each semi-collar with capacity of freely moving along the semi-collar between the hinge means, whereby a stem moving along a semi-collar is prevented from passing into the other semi-collar.

10. The mooring device of claim 1, wherein the collar and stem are made of galvanized steel.

11. The mooring device of claim 1, wherein the shackle is made of galvanized steel, and the stem the small proximal and larger distal rings thereof are only one integral piece made of galvanized steel.

12. The mooring device of claim 1, wherein the stem and the small proximal and larger distal rings thereof are only one integral piece made of galvanized steel.

* * * * *